US009414473B2

(12) United States Patent
Dabringhausen et al.

(10) Patent No.: US 9,414,473 B2
(45) Date of Patent: Aug. 9, 2016

(54) DISCHARGE LAMP WITH CONTACT PATHS WITHIN THE BASE

(71) Applicant: KONINKLIJKE PHILIPS N.V., Eindhoven (NL)

(72) Inventors: Lars Dabringhausen, Baesweiler (DE); Juergen Gerhard Mertens, Aachen (DE); Anton Duschl, Hauzenberg (DE)

(73) Assignee: Koninklijke Philips N.V., Eindhoven (NL)

( * ) Notice: Subject to any disclaimer, the term of this patent is extended or adjusted under 35 U.S.C. 154(b) by 157 days.

(21) Appl. No.: 14/396,817

(22) PCT Filed: Apr. 9, 2013

(86) PCT No.: PCT/IB2013/052819

§ 371 (c)(1),
(2) Date: Oct. 24, 2014

(87) PCT Pub. No.: WO2013/160784

PCT Pub. Date: Oct. 31, 2013

(65) Prior Publication Data

US 2015/0084507 A1 Mar. 26, 2015

Related U.S. Application Data

(60) Provisional application No. 61/638,553, filed on Apr. 26, 2012.

(51) Int. Cl.
*H01J 5/54* (2006.01)
*H05B 41/38* (2006.01)
(Continued)

(52) U.S. Cl.
CPC ..... *H05B 41/388* (2013.01); *H01J 5/54* (2013.01); *H01R 12/57* (2013.01); *H01R 33/945* (2013.01); *Y10T 29/49169* (2015.01)

(58) Field of Classification Search
CPC ..... H01J 5/50; H01J 5/54; H01J 5/56; H01R 12/50; H01R 12/55; H01R 12/57; H01R 33/945
See application file for complete search history.

(56) References Cited

U.S. PATENT DOCUMENTS 6,342,766 B1 1/2002 Cook et al.
2004/0095766 A1 * 5/2004 Chan ..... F21S 6/003 362/285

(Continued)

FOREIGN PATENT DOCUMENTS

DE 19509112 A1 9/1996
DE 102011080061 A1 2/2012

(Continued)

*Primary Examiner* — Anne Hines

(57) ABSTRACT

A lamp 10 is described comprising a burner 14 fixed to a lamp base 12. An operating circuit 50 is arranged within the lamp base 12 for supplying electrical power to the burner 14. The operating circuit 50 is electrically connected to at least one elongate contact path element 70 extending within the base. The contact path element 70 is supported within the base 12 and comprises a first portion 70*a* fixed within the base and a second portion 70*b* slidably received within the base 12. The contact path element 70 is fixed to the operating circuit 50 at a position arranged in longitudinal direction from the second portion 70*b*. This allows a manufacturing method, where the contact path element is fixed to the operating circuit 50 at a position arranged in longitudinal direction from the second portion, so that a longitudinal movement of the second portion is possible to compensate for manufacturing tolerances.

14 Claims, 5 Drawing Sheets

(51) Int. Cl.
*H01R 33/945* (2006.01)
*H01R 12/57* (2011.01)

(56) References Cited

U.S. PATENT DOCUMENTS

2006/0119282 A1 6/2006 Hackenbuchner et al.
2009/0303702 A1* 12/2009 Ellis ..... F21S 9/02 362/183
2012/0106157 A1* 5/2012 Simon ..... F21V 25/04 362/249.05

FOREIGN PATENT DOCUMENTS

EP 0923105 A1 6/1999
JP 2006185625 A 7/2006
KR 2001087731 A 9/2001
WO 9520238 A1 7/1995

* cited by examiner

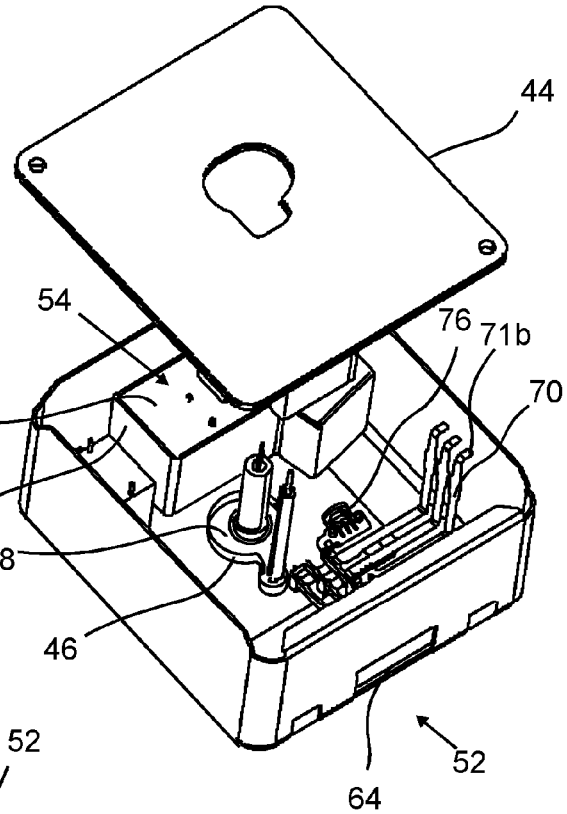
FIG. 6
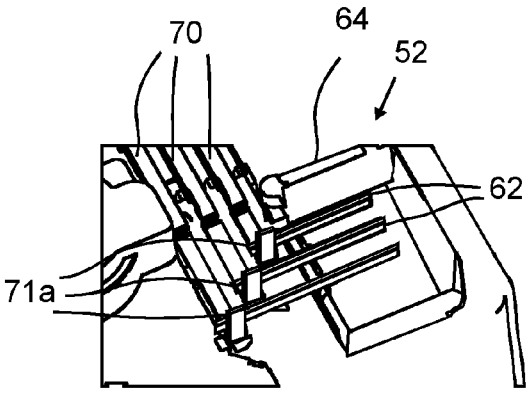
FIG. 7
FIG. 9
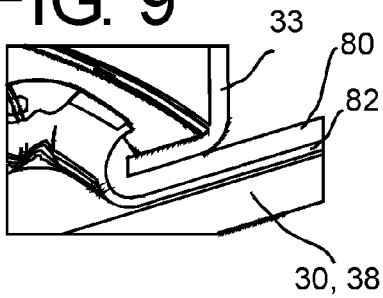
FIG. 8
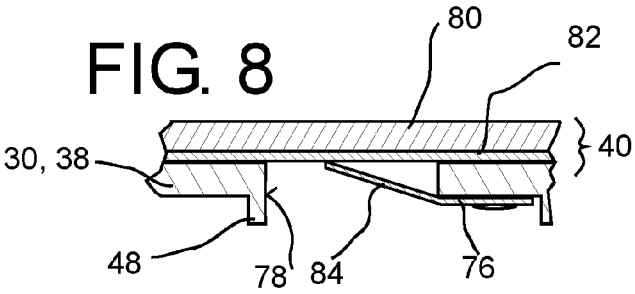

DISCHARGE LAMP WITH CONTACT PATHS WITHIN THE BASE

CROSS-REFERENCE TO PRIOR APPLICATIONS

This application is the U.S. National Phase application under 35 U.S.C. §371 of International Application No. PCT/IB2013/052819, filed on Apr. 9, 2013, which claims the benefit of U.S. Provisional Patent Application No. 61/638,553, filed on Apr. 26, 2012. This application is hereby incorporated by reference herein.

FIELD OF THE INVENTION

The present invention relates to a lamp and a method of manufacturing a lamp, in particular to a discharge lamp, and more specifically to a lamp for use in a vehicle headlight.

BACKGROUND OF THE INVENTION

Electrical discharge lamps, in particular high intensity discharge (HID) lamps are widely used today, e. g. in vehicle headlights. While first generations of such automotive HID lamps comprised a lamp base only for mechanical mounting and electrical contacting of a burner, currently developed lamps include circuitry for operation and/or ignition of the burner integrated within the lamp base.

The present invention deals with providing electrical contacts within the lamp base to components of an operating circuit.

U.S. 2006/0119282 A1 describes a high-pressure discharge lamp having a lamp base with an integrated starting apparatus. An electromagnetic shield is provided, which is connected to the ground reference potential of an operating device. The electromagnetic shield is provided as a metal housing which surrounds the lamp base, and has an aperture for a discharge vessel and for electrical connection of the lamp. The metal housing is made from aluminum or from an aluminum/magnesium alloy, or from a galvanized steel sheet. Inside, a lead frame is provided with electrical components of the starting apparatus, which comprises metallic webs embedded in electrically insulating plastic. A metallic tongue protrudes from the lead frame and out of the interior of the lamp base. In the mounted state, the metallic tongue of the metal web is in electrical and mechanical contact with a wall part of the metal housing. The metallic web, in a similar manner to a leaf spring, bears against the metal housing with a clamping fit.

SUMMARY OF THE INVENTION

It may be considered an object to provide a lamp and a manufacturing method therefor allowing reliable electrical contacting.

This object is solved by a lamp and by a method for manufacturing a lamp as described and claimed herein. Dependent claims refer to preferred embodiments of the invention.

The lamp according to the invention comprises a burner, preferably a HID (high intensity discharge) burner, fixed to a lamp base. An operating circuit is provided within the base. The operating circuit serves to supply electrical power to the burner and may comprise circuitry for ignition and/or for supplying an alternating current to the lamp during steady state operation. Preferably, the operating circuit comprises both an ignitor and a driver circuit, such that the lamp may be fully operated by a mere supply of vehicle onboard voltage.

According to the invention, at least one elongate contact path element is provided extending within the base. The contact path element is preferably a metal strip or web, e.g. made of sheet metal, such as steel. The contact path element is electrically connected to at least one component of the operating circuit, preferably to a circuit carrier, such as a printed circuit board, mounting a plurality of electrical components of the operating circuit.

The invention provides that the contact path element is supported within the base, preferably within a base housing, in a special way. A first portion of the contact path element is fixed within the base, and a second portion thereof is slidably received within the base. Thus, the first portion of the contact path element is fixed and not moveable relative to the base, whereas the second portion is only slidably received and not fully fixed, such that it may move in longitudinal direction thereof.

Further, the contact path element is fixed to the operating circuit at a position arranged in longitudinal direction from the second portion thereof.

As will be explained below with reference to preferred embodiments, this special support of the contact path element has been found advantageous for simple manufacture and reliable electrical contact. The contact path element retains, during manufacture, a certain flexibility to longitudinally move while being slidably received within the base. This allows to establish a reliable connection, e.g. by soldering, welding or other types of connection fixing the contact path element to the operating circuit. A certain amount of slidable movement of the second portion of the contact path element allows compensating for possible manufacturing tolerances to ascertain that reliable contact is made.

In the manufacturing method according to the invention, a lamp base as described is provided, to which a burner may already be fixed, or where a burner may later be fit. During manufacture, the contact path element is fixed to the operating circuit at a position, which is arranged in longitudinal direction of the second portion.

According to preferred embodiments of the invention, the base comprises a non-conductive holder element, preferably made of plastic, which may be arranged within, or may be part of a housing of the base. The contact path element may be fixed at the first portion thereof to the holder element, e.g. by clamping, gluing, embedding etc. The second portion of the contact path element may be slidably received within the holder element. Preferably, it is enclosed within an opening or recess, preferably an elongate channel, of the holder element.

In a preferred embodiment, the second portion of the elongate contact path element is received to be guided within a non-conductive enclosure. The enclosure preferably surrounds the contact path element at the second portion at least partly, preferably fully, such that it may be guided with respect to all traverse directions, but remains slidably moveable in longitudinal direction thereof.

According to a further preferred embodiment, the contact path element comprises a third section arranged between the first and second section thereof. A spring space is provided within the housing, such that the third section is arranged to be moveable into said spring space in response to a longitudinal motion of the second section. Thus, as, during manufacturing, the slidably received second section of the contact path element moves in longitudinal direction thereof, this may result in a deflection of the contact path element at the third section, such that it may enter the provided free spring space to a varying extent, dependent on the longitudinal motion of the second section. By providing a spring space and moveable third section, it is easily possible to compensate for manufacturing tolerances, such that the connection of the contact path element to the operating circuit can be made reliably, e. g. by soldering.

Preferably, the contact path element in the readily manufactured lamp may be spring-loaded to exert a force in longitudinal direction of the second portion thereof. During manufacture, it is preferred that the operating circuit, preferably at a contact surface, is pressed against the contact path element such that the second portion thereof is displaced in longitudinal direction of the second portion. This may lead to a spring-loaded arrangement of the contact path element in respect of the operating circuit, such that the contact path element by its corresponding arrangement presses against the contact surface, ensuring a reliable contact.

According to a preferred embodiment of the invention, the contact path element is bent to form an angle. This angle may be formed between the first and second section thereof. Preferably, the angle is formed between the third and second section. The angle may be e.g. 30 to 120° and preferably corresponds at least substantially (e.g. +/−10°) to a right angle of 90°.

The contact path element is preferably fixed to a carrier of the operating circuit, such as a leadframe or a printed circuit board (PCB), comprising at least some components of the operating circuit. It is especially preferred that the contact path element is fixed to a contact surface by soldering. A soldering connection may be reliably made in particular when the contact path element is pressed against the contact surface. In order to allow external access of a tool, e.g. for soldering, welding, crimping etc, the holder element preferably comprises an opening allowing access to the fixing position of the contact path element to the operating circuit.

The contact path element is preferably a flat, bent element made out of sheet metal. It is further preferred that a plurality of contact path elements are arranged at least substantially in parallel. Further, it is preferred that the contact path element connects the operating circuit to a plug/socket connector provided to be accessible from outside of the base.

BRIEF DESCRIPTION OF THE DRAWINGS

These and other aspects of the invention will be apparent from and elucidated with reference to the embodiments hereinafter.

In the drawings,

FIG. 6 shows a perspective exploded view of parts of the lamp of FIG. 1-5;

FIG. 7 shows a perspective view of parts of the lamp of FIG. 1-6;

FIG. 8 shows a partial sectional view of the lamp of FIG. 1-7;

FIG. 9 shows a sectional perspective view of parts of the lamp of FIG. 1-8 with the section along A . . . A in FIG. 1;

DESCRIPTION OF EMBODIMENTS

Figure 1:
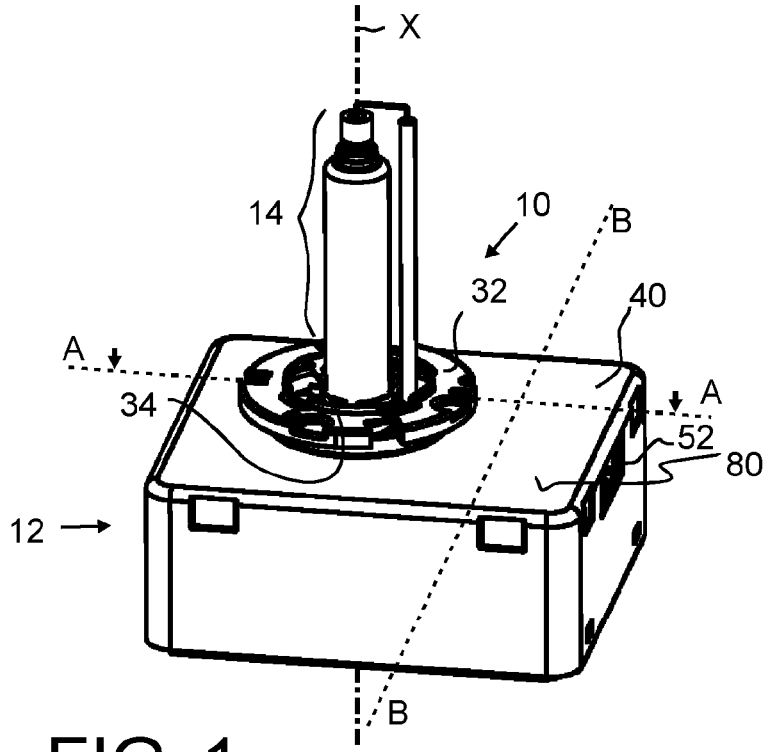
FIG. 1 shows a perspective view of an embodiment of an automotive HID lamp.

FIG. 1 shows a lamp 10 including a lamp base 12, from which a burner 14 protrudes.

Figure 2:
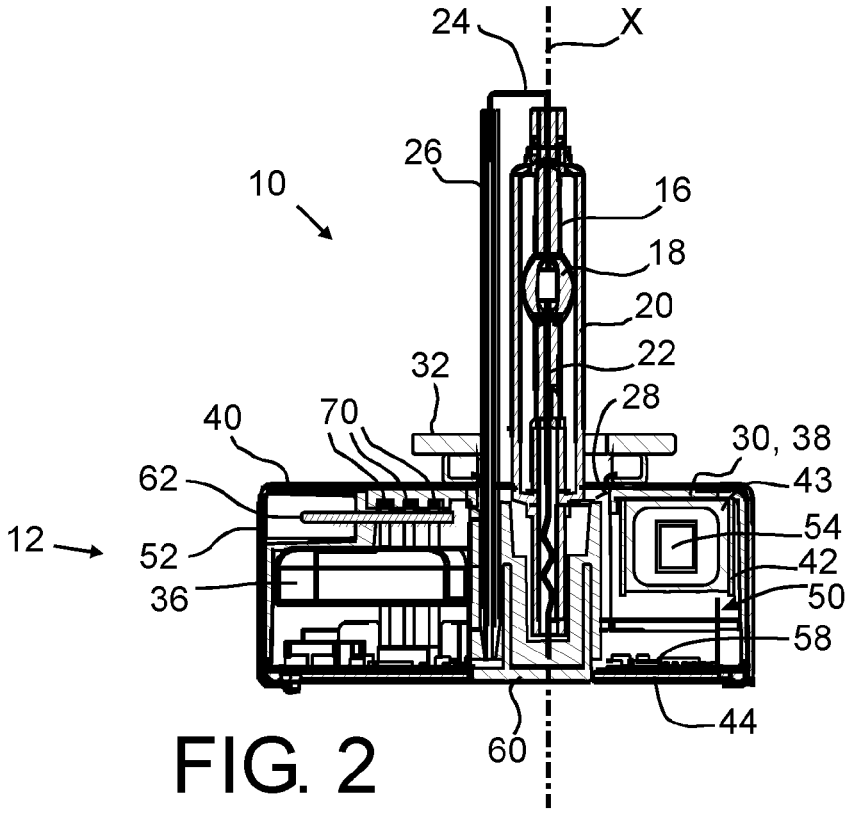
FIG. 2 shows a sectional view of the lamp of FIG. 1 with the section along A . . . A in FIG. 1.

As visible in particular from the cross-sectional view of FIG. 2, the burner 14 is comprised of a burner tube 16 forming a discharge vessel 18 with an enclosed discharge space and an outer bulb 20 arranged around the discharge vessel 18. The outer bulb 20 and the burner tube 16 with the discharge vessel 18 are made of quartz glass material. Within the discharge space, which comprises a filling of metal halides and Xenon, a first and second electrode are provided. The first electrode is electrically connected to a first, central contact lead 22 extending within the burner tube 16 into the housing 12. A second electrode is connected to a return contact lead 24 extending in parallel to the longitudinal axis X of the burner 14. A ceramic tube 26 is arranged around the return contact lead 24 for insulation.

The burner 14 is mechanically held relative to the lamp cap housing 12 by a holding ring structure 32 provided around the burner 14, fixed to a collar of the burner 14 by spot-welded spring tongues.

The lamp base 12 comprises a metal outer housing 40, an inner housing holder element 30, and a bottom plate 44. All of the outer housing wall elements 40, 44 are made out of aluminum as a metal material of good heat conduction properties. The inner holder element 30 is made out of a plastic material.

Within the lamp base 12, electrical components of a lamp operating circuit 50 are arranged. The lamp operating circuit 50 is supplied with electrical power from an electrical plug/socket connector 52 opening to the side of the lamp base 12. For use in a motor vehicle headlamp, the lamp 10 is electrically connected to onboard electrical power and to ground via the connector 52. The lamp operating circuit 50 integrated within the lamp base 12 provides all circuitry required to adapt the voltage supplied at connector 52 to the type of electrical driving voltage and current required for the operation of the burner 14 during ignition, following run-up and steady-state operation. The lamp operating circuit 50 comprises on a printed circuit board 58 and connected thereto circuitry and electrical components for ignition and operation of the lamp 10 as well as a microcontroller for controlling operation of to the burner 14.

Figure 3:
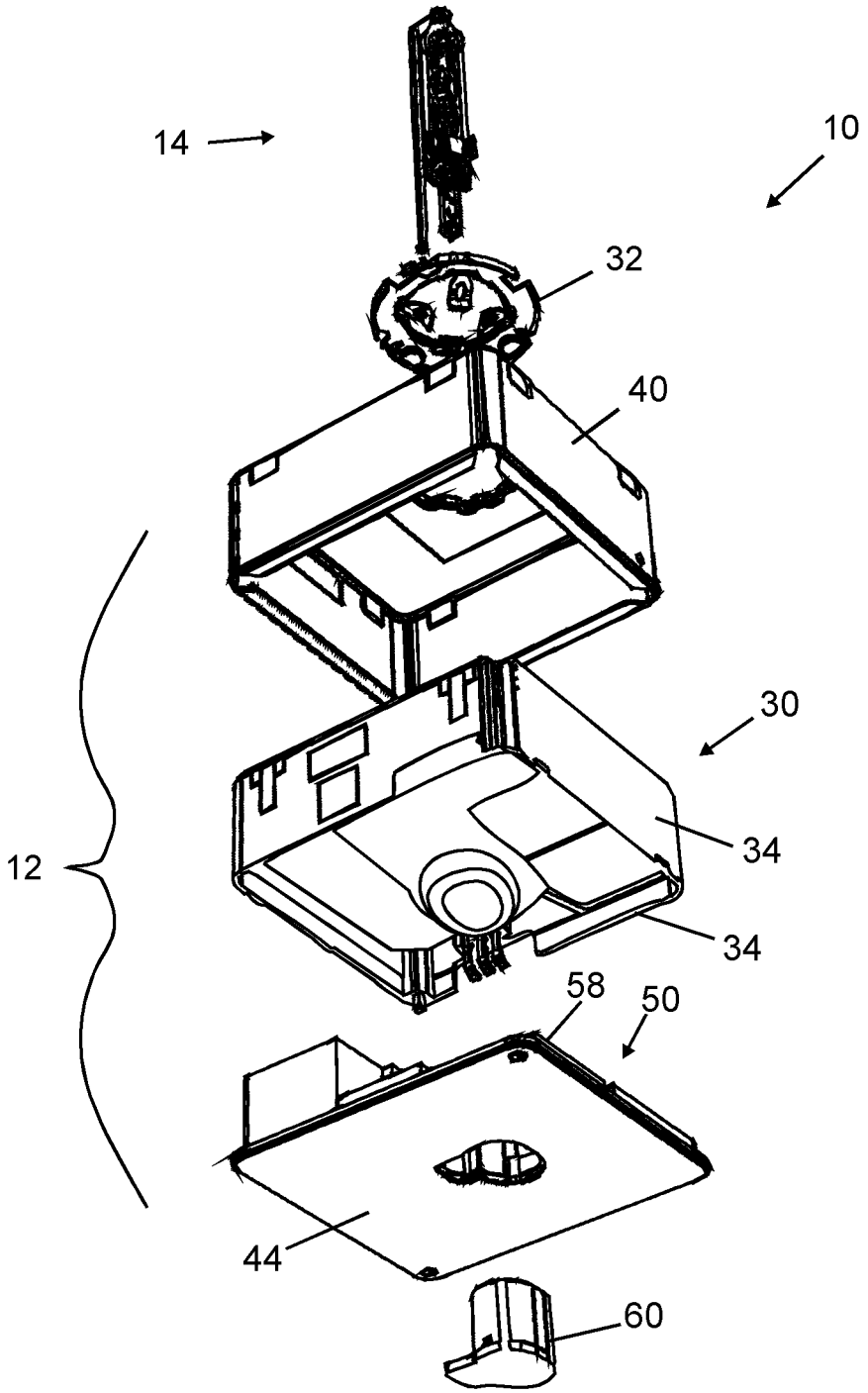
FIG. 3 shows an exploded view of the lamp of FIG. 1, FIG. 2.

As visible from the exploded view shown in FIG. 3 (where some internal parts within the base are not shown for better understanding), the plastic holder 30 is enclosed within the aluminum housing 40. As will be explained below, the holder 30 serves for mounting a plurality of components of the lamp operating circuit 50, such as a transformer and the electrical plug/socket connector 52. The holder 30 further holds electrical contacts of these components. The holder 30 is substantially box-shaped with side walls 34 and a top wall 38. The top wall 38, as shown in FIG. 2, is oriented towards the burner 14, covered by the metal housing 40.

As visible in particular from the cross-sectional view of FIG. 2, the burner 14 is mounted at a central opening 28, and is arranged to protrude quite a distance axially along the longitudinal axis X into the lamp base 12. The result of the corresponding arrangement of the burner 14 quite deep within the lamp base 12 leads to a reduced light center length (LCL), i.e. distance between the center of the discharge vessel 18 relative to the holding ring 32 comprising position reference elements for relative positioning within a reflector of a motor vehicle headlight unit.

As the burner 14 is thus installed to protrude into the lamp cap housing 12, the electrical contact leads from the burner 14, namely the central contact lead 22 and return contact lead 24, also extend into the lamp cap housing 12. In operation of the lamp 10, and in particular during ignition, insulation needs to be provided to prevent flashover between the electrical contact leads 22, 24 as well as from any of the contact leads 22, 24 to components or contact leads of the lamp operating circuit 50 or parts of the lamp cap housing 12. In order to provide this insulation, a plastic cap 60 is provided, covering the central contact lead 22 and the return contact lead 24 axially. The cap 60 serves to provide electrical insulation, in particular between the central contact lead 22 and return contact lead 24, but also between the contact leads 22, 24 and the metal bottom plate 44.

Components of the lamp operating circuit 50 are arranged on a printed circuit board 58 provided within the lamp base 12, holding and electrically interconnecting the electrical circuit components provided thereon. The printed circuit board (PCB) 58 with electrical components mounted on a top surface is arranged directly on the bottom plate 44. Thus, there is close thermal contact between the lamp operating circuit 50 and the bottom plate 44, so that the bottom plate 44 serves as heat sink.

The operating circuit 50 arranged within the base 12 comprises all necessary circuitry, such that the lamp 10 for all modes of operation requires only connection to the onboard voltage of a motor vehicle, which may be supplied at the plug/socket connector 52. The operating circuit 50 includes an ignitor for supplying a high voltage to the burner 14 for igniting an arc discharge within the discharge vessel 18. The operating circuit further comprises a driver circuit for generating an alternating current for operation of the burner 14 in a run-up period after ignition and in subsequent steady-state operation. The operating circuit 50 comprises a micro-controller for control of the operation of the components of operating circuit 50 and of the burner 14.

As shown in FIG. 7, the plug/socket connector 52 comprises three contacts 62 protruding within a socket cavity 64 formed within the holder element 30. One of the contacts 62 is a ground contact, connecting the lamp 10 to electrical ground of the vehicle onboard electrical system. The other contacts are provided for a supply voltage (onboard voltage of the vehicle, e.g. 12 V) and for transmitting communication control signals from an electronic control unit (ECU) on board of the vehicle to the micro-controller of the operating circuit 50 and vice versa.

FIG. 4-7 show how the electrical contacts 62 of the plug/socket connector 52 are connected to the PCB 58 via contact path elements 70, which are held by the holder 30.

Figure 4:
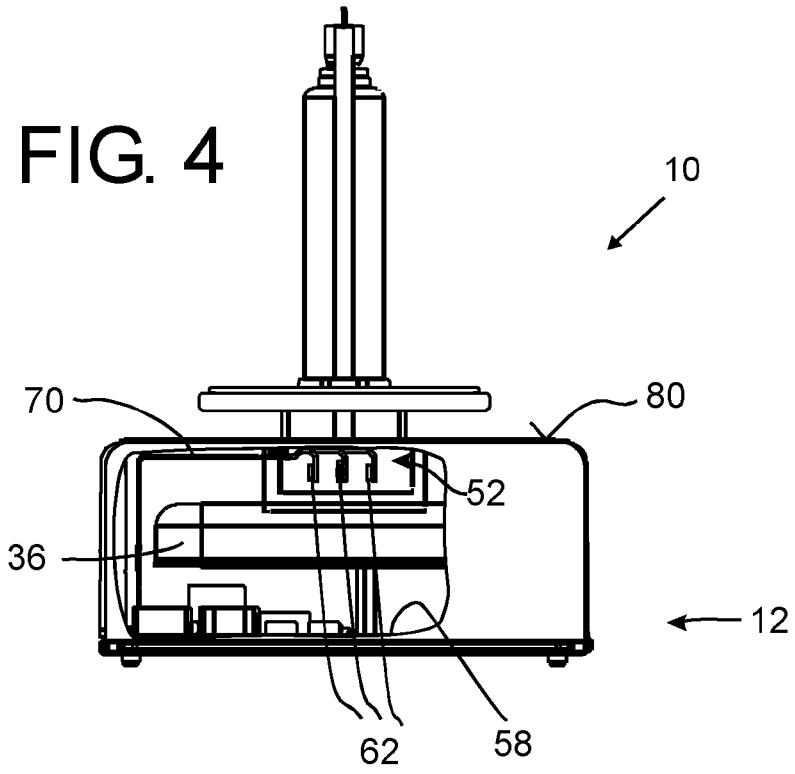
FIG. 4 shows a side view of the lamp of FIG. 1-3 with a partially cut-away housing.

The contact path elements 70 are flat, elongate metal strips or webs. Corresponding to the three contacts 62 of the plug/socket connector 52, there are three contact path elements 70 arranged in parallel within the base 12, extending from the connector 52 to the PCB 58. The contact path elements 70 are bent roughly L-shaped, as shown in FIG. 4 (where the holder 30 is not shown), FIG. 5. Both ends of the contact path elements 70 are bent to form contact flaps 71*a*, 71*b* for contacting the electrical contacts 62 of the connector 52 and for contacting contact surfaces of the PCB 58. Each contact flap 71*a* of the contact path element 70 is fixed to one plug contact 62 via spot welding, and each contact flap 71*b* is fixed to one contact surface 72 by soldering.

Figure 5:
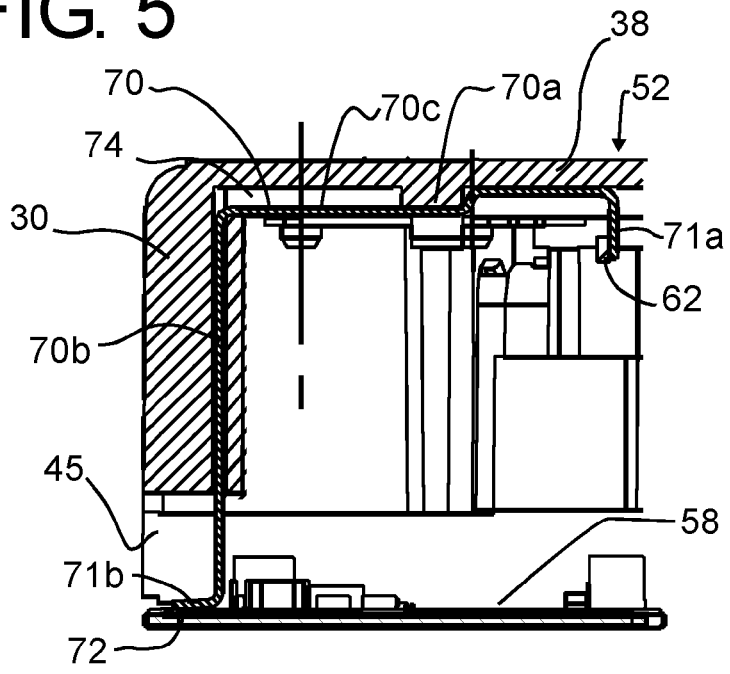
FIG. 5 shows an enlarged partial sectional view of the lamp of FIG. 1-4 with the section along B . . . B in FIG. 1.

As visible from FIG. 4, FIG. 5 (where the metal outer housing 40 is not shown), the contact path elements 70 extend from the connector 52 in a first portion 70*a* substantially in parallel to the upper surface of the base 12, oriented towards the burner (i. e. horizontally in FIG. 4, FIG. 5). The first portion 70*a* of the contact path elements 70 is fixed to the holder 30 by partly embedding the first portion 70*a* of the contact path elements 70 within the plastic material.

The contact path elements 70 are bent at an angle of about 90° to continue as a second section 70*b* towards the PCB 58, i. e. substantially in parallel to the longitudinal axis X of the lamp 10. The second section 70*b* of the contact path elements 70 is held and guided by the holder 30, but not fixed thereto. The holder 30 provides an elongate opening, through which the second section 70*b* of the contact path elements 70*a* protrudes, such that each of the metal webs is surrounded by the plastic material of the holder 30 in traverse directions. Thus, the second section 70*b* of the contact path elements 70 is slidably received within the opening of the holder 30, such that it is movable in longitudinal direction while being guided in traverse direction by the enclosing plastic material.

During assembly of the lamp 10, the assembled PCB 58 is connected to the holder 30 as shown in the exploded view of FIG. 3, such that the second contact flaps 71*b* of the contact path elements 70 come to rest on the contact surfaces 72 of the PCB 58.

In order to be able to establish a reliable solder connection, the holder 30 and the contact path elements 70 are pre-assembled with the length of the second section 70*b* designed for an interference fit, i. e. longer than necessary for an exact 90° bend between the first section 70*a* and second section 70*b* of the contact path elements 70. Thus, before assembly, the contact flaps 71*b* extend out of the holder 30 to protrude a small distance below. As the PCB 58 is fitted, a force acts longitudinally on the second section 70*b* of a contact path element 70, such that this section of the contact path elements 70 slides longitudinal within the guiding fit of the holder 30. Within the base 12, the holder 30 leaves a spring space 74 free, into which a third section 70*c* of the contact path elements is received as it is deflected by the force exerted on the second section 70*b* of the contact path elements 70.

By providing the mentioned oversize, slidable reception and spring space 74, a clamping fit of the contact flaps 71*b* on the contact surfaces 72 of the PCB 58 is achieved, where a spring force of the deflected third section 70*c* of the contact path elements 70 achieves a pressing force, pressing the contact flaps 71*b* onto the contact surfaces 72. Subsequently, the solder connection is made.

The holder 30 comprises an opening 45 which allows access to the contact flaps 71*b* and contact surfaces 72 for soldering.

As already mentioned, one of the contacts 62 provided at the connector 52 is an electrical ground contact, connected to electrical ground of the motor vehicle. As shown in FIGS. 6, 8, a contact spring 76 is provided in one piece with one of the contact path elements 70 serving as the electrical ground contact, the contact spring 76 being provided to establish an electrical ground connection to the metal housing 40.

The holder 30 includes an opening 78 provided within the top wall 38. The contact spring 76 is fixed to the holder 30 and extends through the opening 78 up to the metal housing 40.

As shown in the partial views of FIGS. 8, 9, the top surface 80 of the base 12 is a metal sheet element which is part of the metal housing 40 and is made from aluminum. A contact sheet element 82 is arranged flat underneath the top surface 80 of the metal housing 40 in close contact therewith. The contact sheet element 82 is a thin piece of sheet metal made from a steel material, considerably thinner than the aluminum sheet material of the top surface 80.

The burner holding ring 32 includes a flange 33 extending downwardly up to the top surface 80. The burner holding ring 32 is fixed to the base 12 by means of a crimping connection of the top surface 80 of the metal housing 40 with the flange 33. As shown in FIG. 9, the sandwich structure formed of the steel material of the contact sheet element 82 and the aluminum material of the top surface 80 of the metal housing 40 is bent at the central opening 28 for the burner 14 to surround the flange 33 of the burner holding ring 32. The thus formed crimping connection extends around the substantially circular opening 28 in the top surface 80 provided for the burner 14 and is effective to both fix the flange 33, and thereby the burner holding ring 32 to the top surface 80, and also to provide a close mechanical (and thereby also electrical) connection between the contact sheet element 82 and the top surface 80 of the metal housing 40.

As shown in FIG. 6, FIG. 8, the contact spring 76 provides two contact fingers 84 which bear against the lower surface of the contact sheet element 82 in a clamping fit. Thus, the electrical ground connection provided at the connector 52 is brought into electrical contact with the metal housing 40 via the contact spring 76 and the contact sheet element 82.

As already explained, the operating circuit 50 comprises an ignitor for igniting an electrical arc discharge within the discharge vessel 18. The ignitor includes an ignition transformer 54 as shown in FIG. 2, arranged within an insulation chamber 42 with side walls formed integrally with the holder 30. The ignition transformer 54 is embedded, for purposes of electrical insulation, within an insulation compound 43.

The insulation compound 43 is a silicone insulation compound, which is filled into the insulation chamber 42 in upside-down orientation, as e.g. shown in FIG. 6. The transformer 54 is placed within the insulation chamber 42, and the insulation compound 43 is filled into the chamber 42 in a liquid form. The holder 30 including the filled insulation chamber 42 is then placed into an oven for a heat curing treatment of the insulation compound 43, such that the insulation compound 43 solidifies.

During filling of the insulation chamber 42 in the upside-down orientation as shown in FIG. 6, any amounts of the liquid insulation compound 43 possibly leaking from the insulation chamber 42 into the interior of the holder 30 are retained by a retention wall 46 provided around the central opening 28. Thus, leaked amounts of the insulation compound 43 will not leak through the opening 28 onto the—in the upside-down orientation of FIG. 6—bottom surface of the holder 30, i.e. onto the top surface (in FIG. 2) of the base 12, exposed to heat and radiation from the burner 14. Thus, evaporation of silicone, and in particular silicone entering the front parts of the lamp 10 and the reflector, into which the lamp 10 will be mounted, is effectively prevented.

The central opening 28 in the top wall 38 of the holder 30, through which the burner 14 protrudes, is connected with a further opening in the top wall 38, through which the return contact 24 enters the base 12. The retention wall 46 is arranged to surround both openings. Further, the top wall 38 of the holder 30 includes, as already explained, an opening 78 for the ground contact spring 76. The opening 78, as shown in FIG. 8, is also surrounded by raised retention walls 48, extending, in the same way as the retention wall 46 around the central opening 28, perpendicularly from the top wall 38 of the holder 30. Thus, even larger amounts of leaked insulation compound 43 are safely retained within the holder 30 until the curing treatment. During the curing treatment, leaked compound 43 within the interior of the holder 30 will solidify as well, such that there is no further risk of silicone entering the front portions of the lamp 10.

Figure 10:
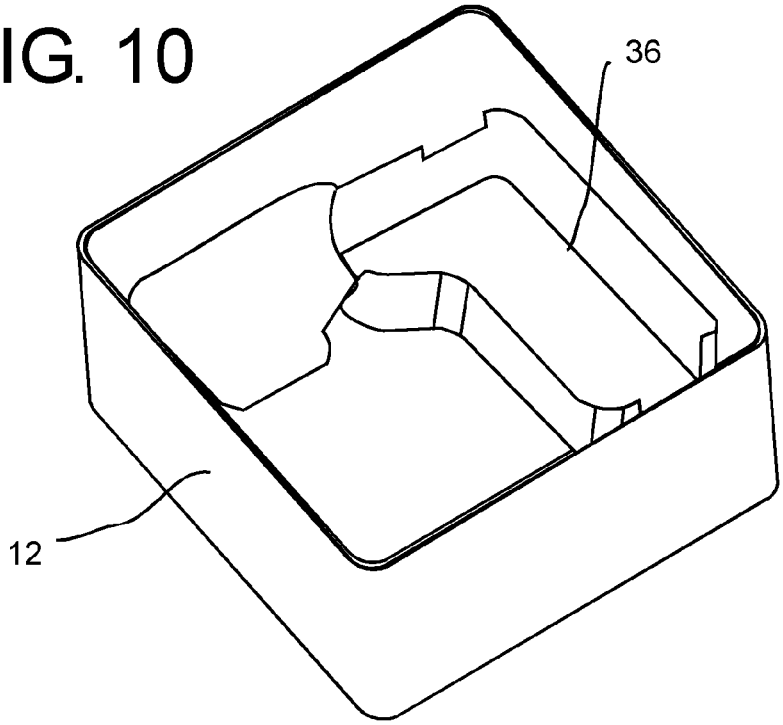
FIG. 10 shows a perspective view of parts of the lamp of FIG. 1-9, including an electromagnetic shield.

As shown in the figures, in particular FIG. 2, the packaging of electrical components and contacts within the base 12 is particularly dense, such that the distances between the electrical components are small. In order to reduce the risk of EMI, in particular from the ignitor components, such as the ignition transformer 54, a metal shield 36, as shown in FIG. 10, is arranged within the base 12. The metal shield 36 is arranged substantially in parallel to the top and bottom surfaces of the base 12, e.g. substantially horizontally, as shown e.g. in FIG. 2, FIG. 4. The metal shield 36 is arranged to partly cover the PCB 58, and in particular to separate components on the PCB 58 from the ignition transformer 54. Further, as shown in FIG. 2, the metal shield 36 is also arranged to partly shield the plug/socket connector 52 and the contact leads 70 from further components within the base 12, in order to prevent EMI from spreading within the base 12 via these connections.

While the invention has been illustrated and described in detail in the drawings and foregoing description, such illustration and description are to be considered illustrative or exemplary and not restrictive; the invention is not limited to the disclosed embodiments.

Variations of the disclosed embodiment can be understood and effected by those skilled in the art in practising the claimed invention, from a study of the drawings, the disclosure and the appended claims. In the claims, the word "comprising" or "including" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. Lamp comprising
a burner fixed to a lamp base,
where an operating circuit for supplying electrical power to said burner is arranged within the lamp base,
and where said operating circuit is electrically connected to at least one elongate contact path element within said lamp base,
said contact path element being supported within said base, where the contact path element comprises at least a first portion fixed within the base, and a second portion, slidably received therein,
and where said contact path element is fixed to at least a part of said operating circuit at a position arranged in longitudinal direction from said second portion.

2. Lamp according to claim 1, where
said second portion is received to be guided within a non-conductive enclosure.

3. Lamp according to claim 1, where
said base comprises a non-conductive holder element, where said first portion of said contact path element is fixed to said holder element,
and where said second portion of said contact path element is slidably received within said holder element.

4. Lamp according to claim 1, where
a spring space is provided within said base,
and said contact path element further comprises at least a third section arranged between said first and second sections,
where said third section is arranged to be moveable into said spring space in response to a longitudinal motion of said second section.

5. Lamp according to claim 1, where
said contact path element is spring-loaded to exert a force in longitudinal direction of said section portion.

6. Lamp according to claim 1, where,
said third section is arranged forming an angle with said second section.

7. Lamp according to claim 1, where
said contact path element is fixed to a contact surface of a carrier comprising components of said operating circuit.

8. Lamp according to claim 1, where said contact path element is fixed to said operating circuit by soldering.

9. Lamp according to claim 1, where said holder element comprises an opening for access to a fixing position of said contact path element to said operating circuit.

10. Lamp according to claim 1, where said contact path element is a flat, bent element made of sheet metal.

11. Lamp according to claim 1, where said operating circuit is connected to a plurality of contact path elements arranged at least substantially in parallel.

12. Lamp according to claim 1, where said contact path element connects said operating circuit to a plug/socket connector provided to be accessible from outside of said base.

13. Method of manufacturing a lamp, where providing a lamp base for a burner, providing an operating circuit disposed to supply electrical power to said burner, providing at least one elongate contact path element within said base, where the contact path element comprises at least a first portion fixed within said base and a second portion slidably received within said base, fixing said contact path element to said operating circuit at a position arranged in longitudinal direction from said second portion.

14. Method according to claim 13, where before said step of fixing said contact path element to said operating circuit, pressing a contact surface of said operating circuit against said contact path element, such that said second portion thereof is displaced in longitudinal direction of said second portion.

* * * * *